US009153220B2

(12) United States Patent
Kanayama et al.

(10) Patent No.: US 9,153,220 B2
(45) Date of Patent: Oct. 6, 2015

(54) ELECTRONIC PERCUSSION INSTRUMENT

(71) Applicant: YAMAHA CORPORATION, Hamamatsu-shi, Shizuoka-ken (JP)

(72) Inventors: Emi Kanayama, Hamamatsu (JP); Masao Sato, Hamamatsu (JP)

(73) Assignee: YAMAHA CORPORATION (JP)

( * ) Notice: Subject to any disclaimer, the term of this patent is extended or adjusted under 35 U.S.C. 154(b) by 0 days.

(21) Appl. No.: 14/204,180

(22) Filed: Mar. 11, 2014

(65) Prior Publication Data

US 2014/0260917 A1 Sep. 18, 2014

(30) Foreign Application Priority Data

Mar. 12, 2013 (JP) ..... 2013-049038
Mar. 11, 2014 (JP) ..... 2014-047222

(51) Int. Cl.

| | |
|---|---|
| ***G10H 1/32*** | (2006.01) |
| ***G10H 7/00*** | (2006.01) |
| ***G10H 3/14*** | (2006.01) |
| ***G10D 13/02*** | (2006.01) |

(52) U.S. Cl.

CPC ..... *G10H 1/32* (2013.01); *G10D 13/024* (2013.01); *G10H 3/143* (2013.01); *G10H 7/00* (2013.01); *G10H 2230/251* (2013.01)

(58) Field of Classification Search

USPC ..... 84/644, 670, 743, 411 R
IPC ..... G10H 1/32,7/00, 2230/251
See application file for complete search history.

(56) References Cited

U.S. PATENT DOCUMENTS

| | | | | |
|---|---|---|---|---|
| 3,250,169 | A | 5/1966 | Stone, Jr. et al. | |
| 4,606,525 | A | 8/1986 | Lombardi | |
| 4,669,349 | A | 6/1987 | Hyakutake | |
| 4,800,795 | A | 1/1989 | Yamashita | |
| 4,947,725 | A | 8/1990 | Nomura | |
| 5,182,416 | A | 1/1993 | Schweizer | |
| 5,337,646 | A | 8/1994 | Austin | |
| 5,583,307 | A * | 12/1996 | Tobia, Jr. | 84/411 R |

(Continued)

FOREIGN PATENT DOCUMENTS

| | | |
|---|---|---|
| EP | 1837860 A2 | 9/2007 |
| JP | 2009128426 A | 6/2009 |

OTHER PUBLICATIONS

U.S. Office Action for related U.S. Appl. No. 14/204,411, mail date Jun. 20, 2014.

(Continued)

*Primary Examiner* — David Warren
(74) *Attorney, Agent, or Firm* — Rossi, Kimms & McDowell LLP

(57) ABSTRACT

An electronic percussion instrument includes a head, a frame, and an impact sensor, and an air ventilation mechanism which includes a pair of cutouts which are distanced from each other and formed in the periphery of the head. The head is attached to the frame such that the periphery of the frame is externally enclosed with the periphery of the head precluding a pair of cutouts. Additionally, a pair of connecting parts with reduced thickness is linearly elongated across the back of the head in parallel. When the head is struck with a beater, a vibration is caused to occur in the head and detected by the impact sensor to produce an electric signal which is used to generate an electronic musical sound, wherein the air ventilation mechanism releases air from the back of the head so as to reliably secure noiselessness while reducing noise.

20 Claims, 13 Drawing Sheets

(56) References Cited

U.S. PATENT DOCUMENTS

| | | | | |
|---|---|---|---|---|
| 5,585,581 | A | 12/1996 | Rogers | |
| 5,864,077 | A * | 1/1999 | Gatzen | 84/414 |
| 5,949,008 | A | 9/1999 | Augsburger | |
| 6,215,053 | B1 * | 4/2001 | Adinolfi | 84/411 R |
| 6,525,249 | B1 * | 2/2003 | Suenaga | 84/411 R |
| 6,580,023 | B2 * | 6/2003 | Belli | 84/411 R |
| 6,653,540 | B2 | 11/2003 | Izen et al. | |
| 6,686,526 | B2 * | 2/2004 | Ezbicki | 84/411 R |
| 6,815,602 | B2 | 11/2004 | De Franco | |
| 6,828,494 | B2 | 12/2004 | Toda | |
| 6,921,857 | B2 * | 7/2005 | Yoshino et al. | 84/738 |
| 6,927,330 | B2 * | 8/2005 | May | 84/411 R |
| 6,949,701 | B2 * | 9/2005 | Okumura | 84/411 R |
| 7,135,630 | B2 * | 11/2006 | Maruhashi et al. | 84/411 P |
| 7,214,867 | B1 | 5/2007 | Gatzen et al. | |
| 7,256,342 | B2 * | 8/2007 | Hagiwara et al. | 84/726 |
| 7,439,432 | B2 | 10/2008 | Hiraku | |
| 7,488,887 | B2 * | 2/2009 | Mori | 84/743 |
| 7,642,439 | B2 * | 1/2010 | Fujii | 84/411 M |
| 7,723,596 | B2 * | 5/2010 | Kelly | 84/421 |
| 7,928,304 | B2 | 4/2011 | Eason et al. | |
| 8,039,724 | B1 | 10/2011 | Norman et al. | |
| 8,263,850 | B2 | 9/2012 | Hashimoto et al. | |
| 8,283,543 | B2 * | 10/2012 | McBain | 84/411 R |
| 8,294,013 | B2 * | 10/2012 | Lento | 84/411 R |
| 8,431,813 | B2 * | 4/2013 | Mori | 84/723 |
| 8,536,435 | B2 | 9/2013 | Mori | |
| 8,563,843 | B1 * | 10/2013 | Shemesh | 84/743 |
| 9,006,555 | B2 | 4/2015 | Mori | |
| 2003/0029301 | A1 * | 2/2003 | Belli | 84/411 R |
| 2003/0037660 | A1 * | 2/2003 | Suenaga | 84/411 R |
| 2003/0070533 | A1 * | 4/2003 | Ezbicki | 84/411 R |
| 2003/0136244 | A1 * | 7/2003 | Okumura | 84/411 R |
| 2003/0188624 | A1 | 10/2003 | Toda | |
| 2003/0188629 | A1 * | 10/2003 | Suenaga | 84/723 |
| 2004/0025663 | A1 | 2/2004 | Harada et al. | |
| 2004/0118269 | A1 | 6/2004 | Yoshino | |
| 2004/0159223 | A1 * | 8/2004 | Kiyono et al. | 84/723 |
| 2004/0211310 | A1 * | 10/2004 | Hagiwara et al. | 84/726 |
| 2004/0261603 | A1 * | 12/2004 | May | 84/411 R |
| 2005/0150366 | A1 | 7/2005 | Susami | |
| 2006/0230912 | A1 | 10/2006 | Pickens | |
| 2007/0051231 | A1 * | 3/2007 | Fujii | 84/723 |
| 2007/0137460 | A1 * | 6/2007 | Mori | 84/421 |
| 2007/0169610 | A1 * | 7/2007 | Pickens | 84/411 R |
| 2007/0295189 | A1 * | 12/2007 | Kelly | 84/421 |
| 2008/0229902 | A1 | 9/2008 | Mori et al. | |
| 2009/0000464 | A1 * | 1/2009 | Mishima | 84/724 |
| 2009/0019985 | A1 * | 1/2009 | Casanta | 84/411 R |
| 2009/0229450 | A1 * | 9/2009 | Hashimoto | 84/723 |
| 2009/0241755 | A1 | 10/2009 | Yoshino et al. | |
| 2010/0175535 | A1 | 7/2010 | Lento | |
| 2010/0282047 | A1 | 11/2010 | Hashimoto et al. | |
| 2010/0307323 | A1 * | 12/2010 | Mori | 84/723 |
| 2011/0030529 | A1 * | 2/2011 | Chen | 84/414 |
| 2011/0138988 | A1 * | 6/2011 | Lento | 84/414 |
| 2011/0219938 | A1 * | 9/2011 | McBain | 84/421 |
| 2012/0174732 | A1 * | 7/2012 | Martinazzi | 84/411 R |
| 2012/0266737 | A1 * | 10/2012 | Mori | 84/421 |
| 2013/0098227 | A1 * | 4/2013 | Wei | 84/723 |
| 2013/0112068 | A1 * | 5/2013 | Rogers | 84/723 |
| 2013/0152768 | A1 | 6/2013 | Rapp | |
| 2013/0340596 | A1 * | 12/2013 | Yao | 84/723 |
| 2014/0020548 | A1 * | 1/2014 | Shemesh | 84/626 |
| 2014/0026733 | A1 * | 1/2014 | Hashimoto | 84/415 |
| 2014/0060284 | A1 * | 3/2014 | Yoshino | 84/411 R |
| 2014/0069256 | A1 * | 3/2014 | Hashimoto | 84/414 |
| 2014/0069265 | A1 | 3/2014 | Shih et al. | |
| 2014/0116229 | A1 | 5/2014 | Mori | |
| 2014/0208926 | A1 | 7/2014 | Shepherd | |
| 2014/0216234 | A1 * | 8/2014 | Wei | 84/723 |
| 2014/0260917 | A1 * | 9/2014 | Kanayama et al. | 84/730 |
| 2014/0260918 | A1 * | 9/2014 | Kanayama et al. | 84/730 |
| 2014/0260919 | A1 * | 9/2014 | Kanayama et al. | 84/730 |
| 2014/0260920 | A1 * | 9/2014 | Kanayama et al. | 84/730 |
| 2014/0260921 | A1 * | 9/2014 | Kanayama et al. | 84/730 |
| 2015/0027301 | A1 | 1/2015 | Shih et al. | |

OTHER PUBLICATIONS

U.S. Office Action for related U.S. Appl. No. 14/204,359, mail date Jul. 9, 2014.
Related U.S. Appl. No. 14/204,359, filed Mar. 11, 2014.
Related U.S. Appl. No. 14/204,411, filed Mar. 11, 2014.
Related U.S. Appl. No. 14/204,563, filed Mar. 11, 2014.
Related U.S. Appl. No. 14/204,247, filed Mar. 11, 2014.
Non-Final Office Action issued in related U.S. Appl. No. 14/204,563, dated Apr. 14, 2015.
Office Action issued in related U.S. Appl. No. 14/204,247 dated Jul. 2, 2015.

* cited by examiner

FIG. 5D
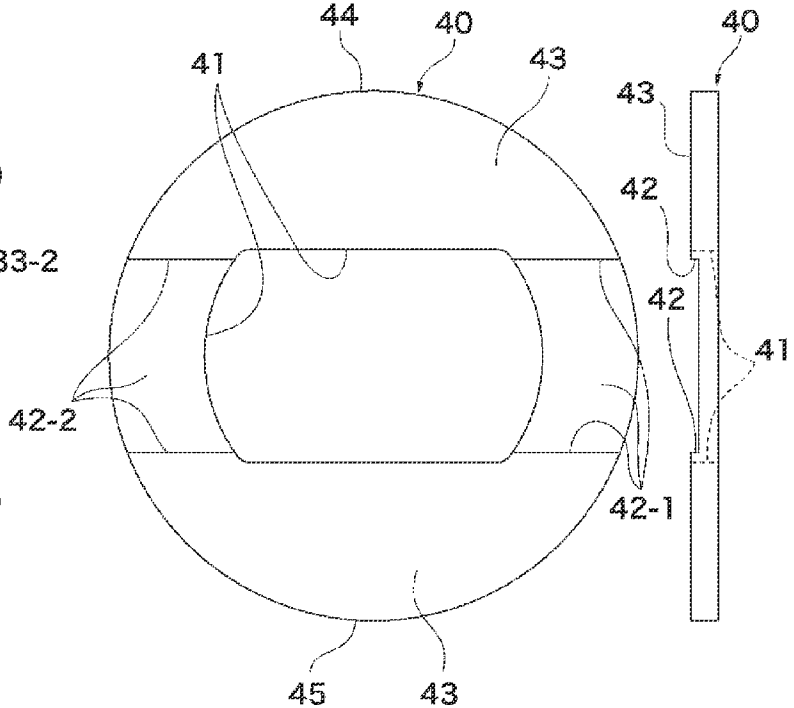
FIG. 5C
FIG. 5B
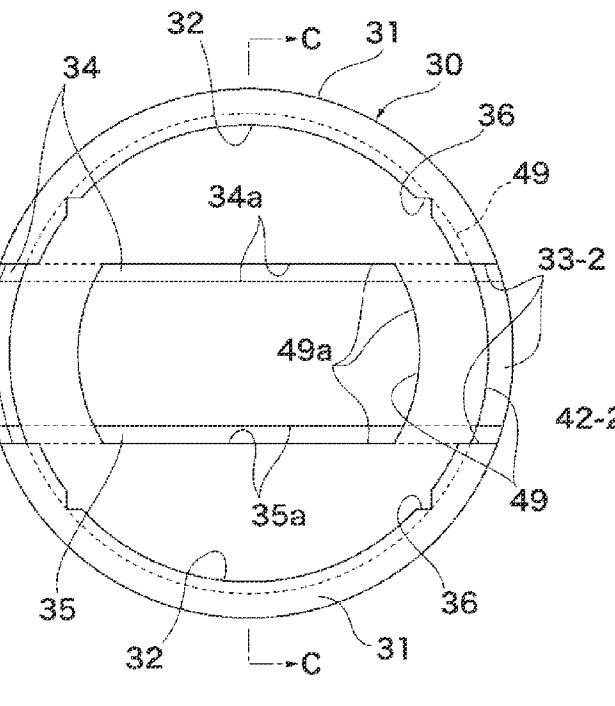
FIG. 5A
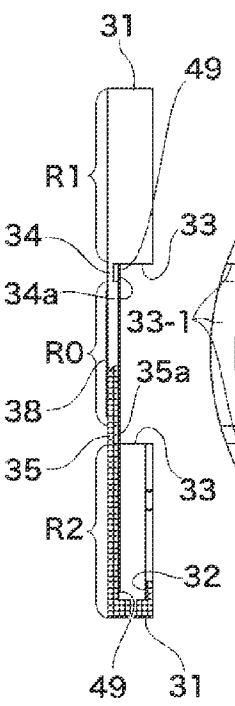

FREQUENCY CHARACTERISTICS OF IMPULSIVE SOUNDS

ELECTRONIC PERCUSSION INSTRUMENT

BACKGROUND OF THE INVENTION

1. Field of the Invention

The present invention relates to an electronic percussion, instrument including an impact sensor which converts vibration of a head being struck with a beater into an electric signal so as to generate an electronic musical sound.

The present application claims priority on Japanese Patent Application No. 2013-49038 and Japanese Patent Application No. 2014-47222, the entire content of which is incorporated herein by reference.

2. Description of the Related Art

Conventionally-known electronic percussion instruments are designed to generate an electronic musical sound based on an electric signal output from an impact sensor which detects vibration of a head being struck with a beater. Patent Literature Document 1 (PLT1) discloses an electronic percussion instrument serving as an electronic bass drum with a circular head, made of an elastic material whose periphery is engaged with a frame. An impact sensor is attached to the back of a strike area corresponding to the center of a head via a center cushion with an outer periphery encompassed by a ring-shaped damper cushion. A vibrating wave occurs when the strike area of a head is struck with a beater. A vibrating wave is transmitted toward the periphery of a head, bounced back, and then attenuated by the damper cushion.

In the electronic percussion instrument of PLT1, a large vibration occurs in the entirety of the internal area of the head, which is positioned inward of the periphery of the head in the radius direction, when the head is struck with a beater, thus rapidly increasing or decreasing the pressure in the back of the head. Due to nonexistence of the thick portion of a frame in the back of the head, it may be possible to slightly vent air via a small gap in the back of the head due to an increase of pressure in the head being struck with a beater. However, the space in the back of die head is occupied by the cushion material which is used to maintain an impact sensor at the predetermined position, which may be an obstacle to the inlet and outlet of air; hence, it is difficult to secure adequate air ventilation in the back of the head of an electronic percussion instrument.

The electronic percussion instrument of PLT1 generates an impulsive sound (i.e. a sound directly caused by an impact of a head being struck with a beater) independently of an electronic musical sound which is generated based on an electric signal output from an impact sensor which, detects vibration occurring on a head being struck with a beater. A large impulsive sound accompanied with art electronic musical, sound is offensive to human's ears, and therefore an impulsive sound may degrade the sound quality of an electronic percussion instrument in terms of articulation; hence, it is difficult to secure "noiselessness" in playing an electronic percussion instrument which electronically generates musical sounds. Additionally, a large impulsive sound may degrade the durability of a head and its related parts in an electronic percussion instrument.

CITATION LIST

Patent Literature Document

Patent Literature Document 1: Japanese Patent Application Publication No. 2009-128426

SUMMARY OF THE INVENTION

It is an object of the present invention to provide an electronic percussion instrument which aims to improve the sound quality while reducing mechanical noise and securing noiselessness by providing adequate air ventilation in the back of a head being struck with a beater.

The present invention is directed to an electronic percussion instrument which generates an electronic musical sound in response to a striking operation applied to a head with a beater.

An electronic percussion instrument of the present invention includes a frame, a head, and an impact sensor. The frame has a head-attaching portion. The head is made of an elastic material with a higher flexibility than the frame. The head includes a main strike area which, is disposed on the surface and mainly subjected to a striking operation. The periphery of the head is directly fixed to the head-attaching portion of the frame. Alternatively, the periphery of the head is fixed to the head-attaching portion of the frame via a joint member. The impact sensor converts a vibration occurring on the main strike area of the head subjected to a striking operation into an electric signal. An opening which allows air to transmit, therethrough at a striking operation is formed in a portion of the head while circumventing the main strike area.

In the above, the opening can be formed in at least one of the periphery of the head, the joint member, and the head-attaching portion. Additionally, the opening may include at least a pair of a first opening and a second opening. It is preferable that the distance between the opposite position of the first opening and the second opening via the main strike area be shorter than the distance between the first opening and the second opening.

Specifically, the opening may include a cutout. The head is attached to the frame such that the periphery of the frame is externally enclosed with the periphery of the head precluding the cutout. Additionally, it is possible to form a thinned portion which is elongated in a horizontal direction in the head. Herein, the cutout is formed at each of the opposite ends of the thinned portion in the periphery of the head.

Additionally, it is possible to form an upper connecting part and a lower connecting part which are linearly elongated in a horizontal direction in the head. An upper area above a main area including the main strike area of the head is connected to the main area via the upper connecting part while a lower area below the main area is connected to the main area via the lower connecting part. The upper connecting part and the lower connecting part are reduced to be thinner in thickness than the upper area and the lower area. The cutout is formed in the main area within the periphery of the head.

Moreover, the electronic percussion, instrument may be further equipped with a cover which is used to cover the periphery of the head. A through-hole is formed at a position of the cover corresponding to the opening. Additionally, the impact sensor is disposed close to the main strike area, of the head via a cushion material.

As described above, the present invention demonstrates advantageous effects such as a vibration-damping effect to suppress a vibration, occurring on a head being struck with a beater so as to attenuate a impulsive sound, and an effect of securing adequate air ventilation in the back of a head being struck with a beater, and an effect of securing noiselessness while reducing mechanical noise during performance of an electronic percussion instrument.

Thus, it is possible to facilitate adequate air ventilation in the back of a head being struck with a beater in an electronic percussion instrument. It is possible to improve workability in assembling a head and a frame together due to the formation of cutouts and notches in the periphery of a head, which, is placed to externally cover the periphery of a frame. It is possible to further improve workability in assembling a head and a frame together due to the formation of a linear thinned portion of a head together with a pair of cutouts which are positioned at the opposite ends of the linear thinned portion of the head when an electronic percussion instrument serves as a twin-beater bass drum set. It is possible to further improve workability in assembling a head and a frame together due to the formation of a pair of connecting parts which are thinned and positioned above and below the back of a strike area of a head. It is possible to reliably cover a head with a cover member having slits without limiting air ventilation.

BRIEF DESCRIPTION OF THE DRAWINGS

These and other objects, aspects, and embodiments of the present invention will be described in more detail with reference to the following drawings.

FIG. 5A is a cross-sectional view taken along line C-C in FIG. 5B.

FIG. 5B is a rear view of a plate of the electronic percussion instrument.

FIG. 5C is a front view of a frame of the electronic percussion instrument.

FIG. 5D is a side view of the frame of the electronic percussion instrument.

DESCRIPTION OF THE PREFERRED EMBODIMENT

The present invention will be described in further detail by way of examples with reference to the accompanying drawings.

Figure 1A:
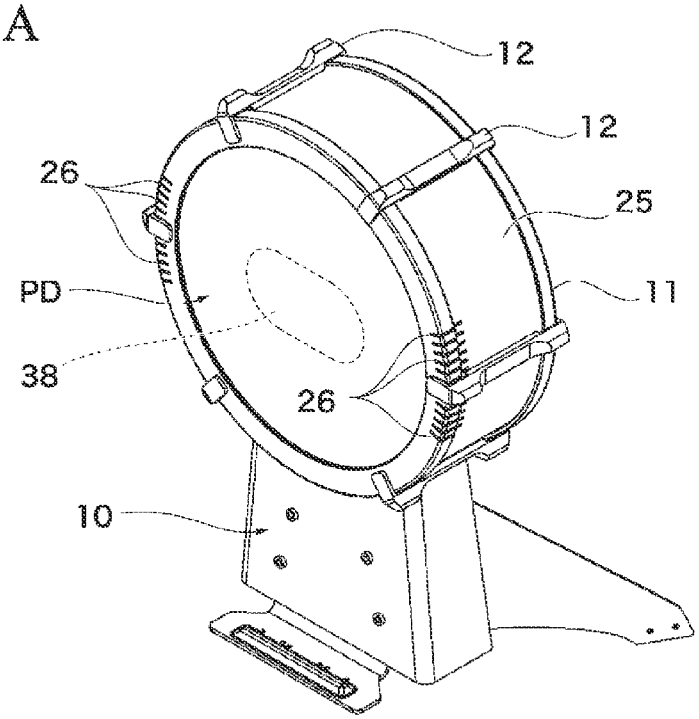
FIG. 1A is a perspective view showing the front side of an electronic percussion instrument according to the preferred embodiment of the present invention.
Figure 1B:
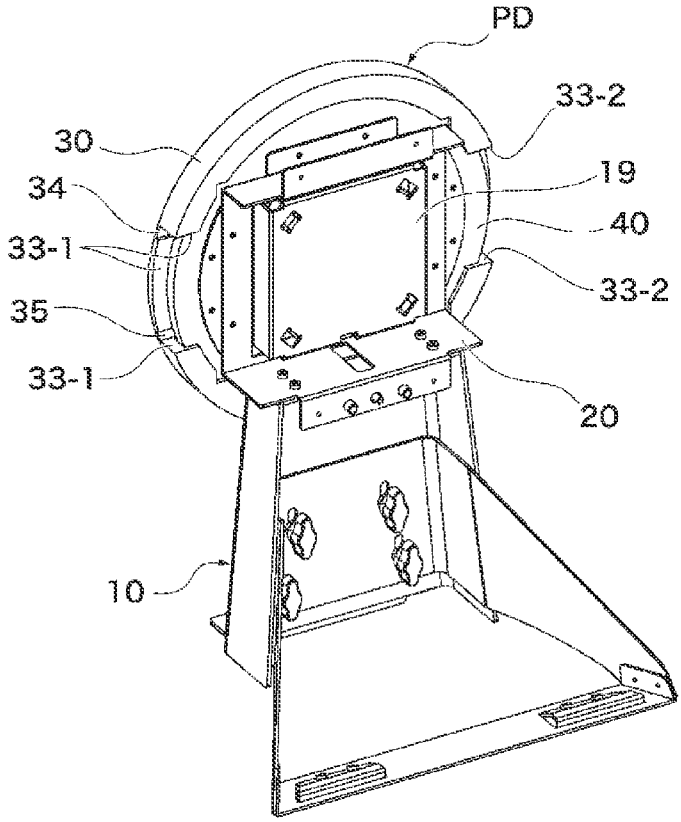
FIG. 1B is a perspective view showing the rear side of the electronic percussion instrument precluding a cover and a panel.
Figure 2B:
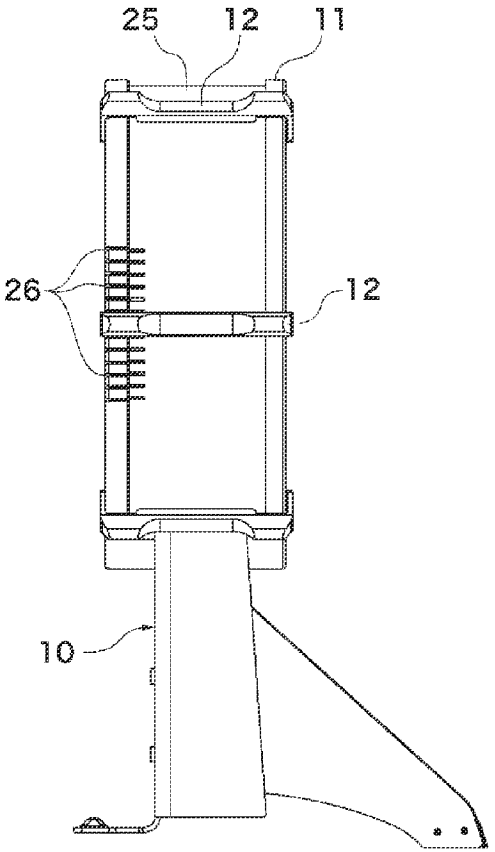
FIG. 2B is a side view of the electronic percussion instrument.
Figure 2A:
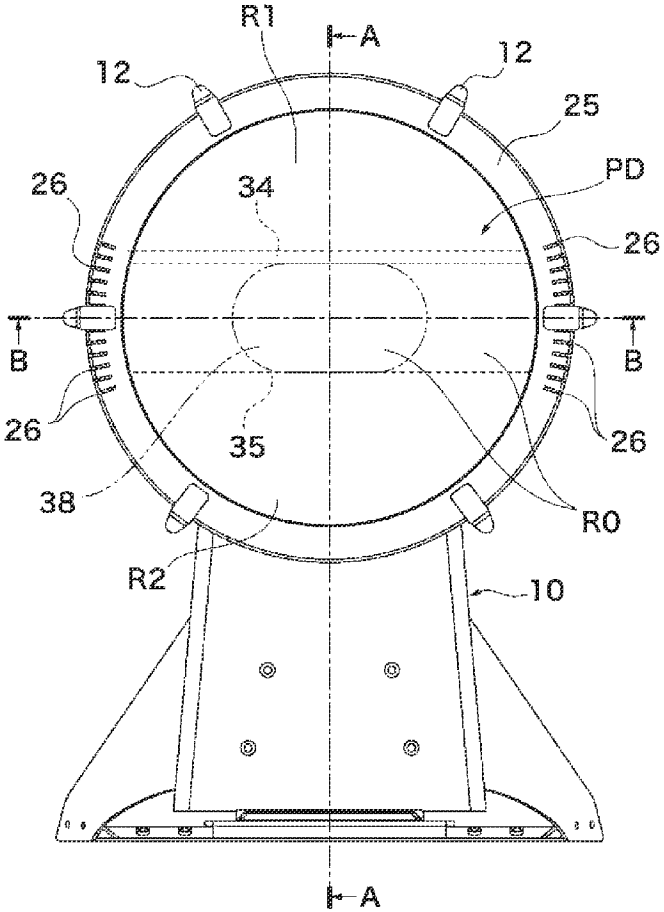
FIG. 2A is a front view of the electronic percussion instrument.

FIG. 1A is a perspective view showing the front side of an electronic percussion instrument according to the preferred embodiment of the present invention, while FIG. 1B is a perspective view showing the rear side of the electronic percussion instrument precluding covers. FIG. 2A is a front view of the electronic percussion instrument, while FIG. 2B is a side view of the electronic percussion instrument.

The electronic percussion instrument of the present embodiment serves as an electronic bass drum in which a main body serving as a kick pad is supported by a stand 10. A foot pedal device (not shown) is additionally attached to the front, side of the electronic percussion instrument in proximity to a player (e.g. a drummer) who plays the electronic percussion instrument. For convenience sake, four directions (i.e. UP, DOWN, RIGHT, LEFT) are determined in the player's view, i.e. in the front, view of the electronic percussion instrument shown in FIG. 2A. Additionally, two directions (i.e. FRONT, REAR) are determined in the player's view, and therefore the front side matches with the player's side.

It is possible to employ the generally-manufactured, product of a foot pedal device, in which a player may operate (or depress) a pedal with his/her foot to strike a circular-shaped pad member PD with a beater (not shown). In this connection, the foot pedal device may include a single beater. The present embodiment is adapted to a twin-beater foot pedal device including two beaters which can be independently operated by a player. For this reason, the circular-shaped pad member PD includes an elliptically-shaped main strike area 38 which can be divided into left and right sides about the center point in the front view in connection with two beaters. That is, the foot pedal device is arranged such that the left and right beaters can strike the left and right sides of the main strike area 38 respectively.

As shown in FIG. 1B, a metal stay 20 is fixed to the upper side of the stand 10. The pad member PD is fixed to the front side of the stay 20 via a flange of a cushion-holding member 19.

Figure 3:
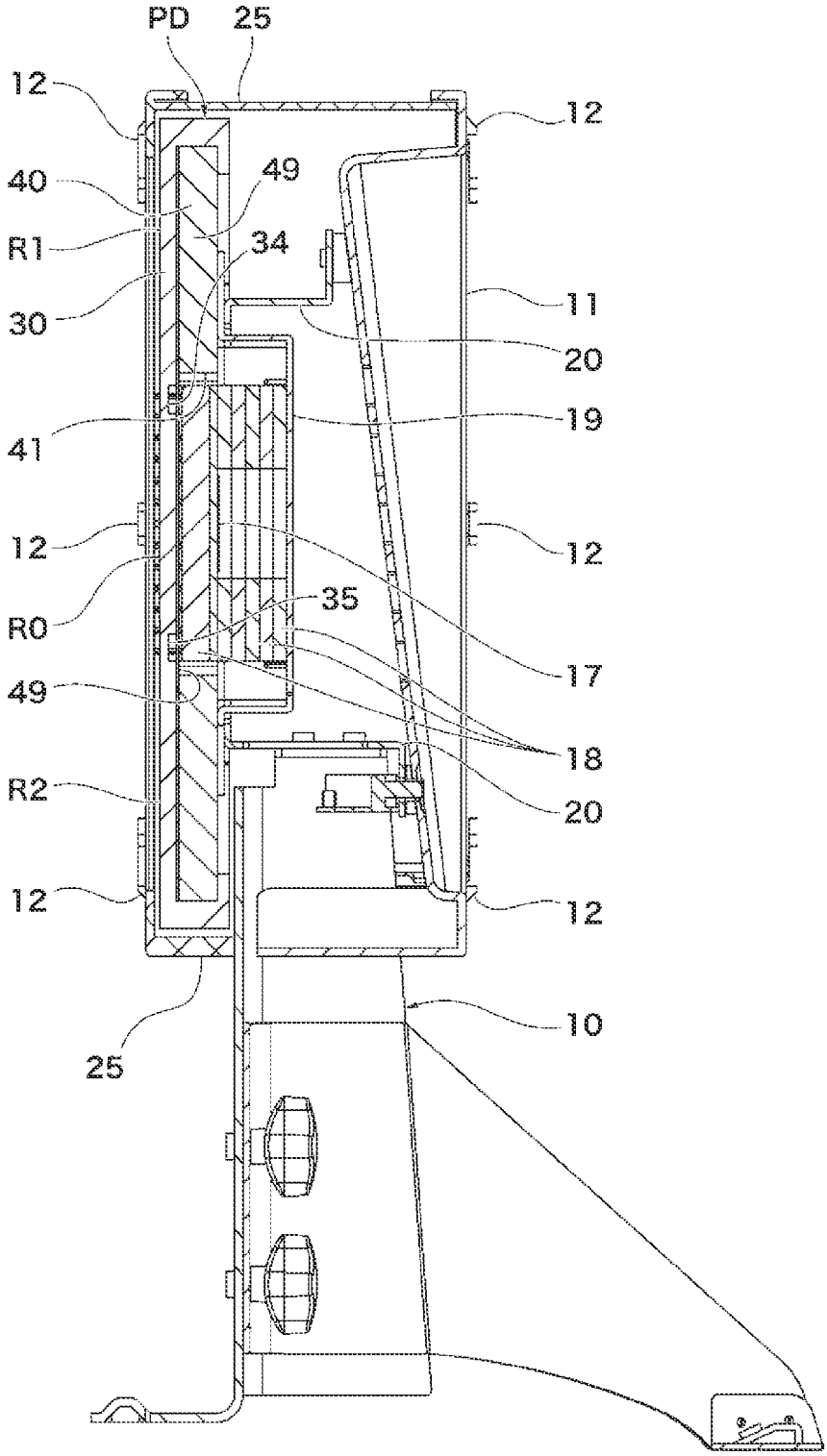
FIG. 3 is a longitudinal sectional view taken along line A-A in FIG. 2A.
Figure 4:
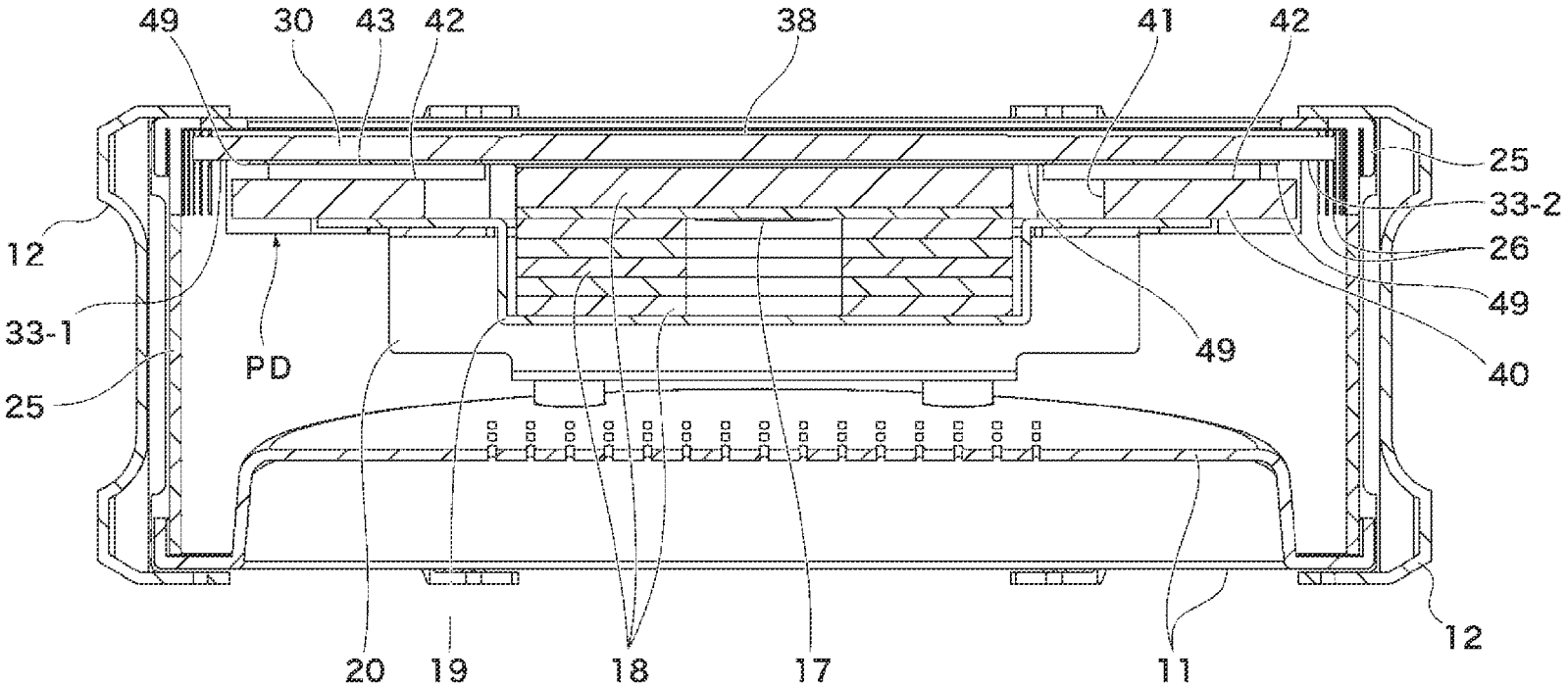
FIG. 4 is a cross-sectional view taken along line B-B in FIG. 2A.

FIG. 3 is a longitudinal sectional view of the electronic percussion instrument along line A-A in FIG. 2A, while FIG. 4 is a cross-sectional view of the electronic percussion instrument along line B-B in FIG. 2A. As shown in FIGS. 3 and 4, a rear cover 11 is fixed to the upper and lower sides of the stay 20 in the rear view. A front cover 25 having a cylindrical shape is fixed to the rear cover 11 by way of six hooks 12 which are separated from each other by equal distances in the circumferential direction of the pad member PD. The external circumference of the pad member PD is entirely covered with the front cover 25.

Next, the details of the pad member PD will be described. The pad member PD includes a head 30 which is integrally formed using an elastic material such as rubber, silicon, and urethane, a frame 40 made of a resin, and a plate 49 made of a hard resin or a metal. The head 30 is made of an elastic material which is softer or more elastic than the material of the frame 40. The plate 49 is made of a material which is harder than the material of the head 30, wherein the plate 49 is a plate member serving as a vibration damper.

FIG. 5A is a cross-sectional view of the head 30, while FIG. 5B is a rear view of the plate 49. That is. FIG. 5A is a cross-sectional side view taken along line C-C in FIG. 5B, thus showing a side view partly in cross section. FIG. 5C is a front view of the frame 40, while FIG. 5D is a side view of the frame 40.

As shown in FIGS. 5A and 5B, the head 30 having a circular shape in a front view includes a periphery 31 (i.e. the external circumference of the head 30). The upper and lower parts of the periphery 31 of the head 30 are folded inwardly in the radius direction to form folded parts 32. A pair of linear grooves 34*a*, 35*a* is formed in parallel to horizontally cross the rear face of the head 30 in the left-right direction of FIG. 5B. Specifically, the grooves 34*a* and 35*a* are U-shaped grooves which are formed by partly engraving the rear face of the head 30 by the predetermined depth such that the remaining parts after engraving are used as connecting parts 34 and 35 serving as hinges. A plurality of cutouts 33 (i.e. 33-1 and 33-2 serving as first and second openings) is formed in the periphery 31 of the head 30 at the left and right edges which exist between, the connecting parts 34 and 35 in the vertical direction. No cutouts 33 are formed in the folded parts 32 of the periphery 31 of the head 30. Instead, a plurality of notches 36 is formed in the folded parts 32 which are separated from each other in the vertical direction.

The head 30 is uniformly formed with the same thickness except, for the folded parts 32 and the connecting parts 34, 35. As shown in FIGS. 2A and 5A, the intermediate area formed between the connecting parts 34 and 35 in the vertical direction is a main area R0 including the main strike area 38 which is actually struck with a beater (or beaters). An upper area R1 is formed above the connecting part 34, while a lower area R2 is formed below the connecting part 35. The upper area R1 and the lower area R2 are auxiliary areas which do not encompass the main strike area 38 of the head 30. The main area R0 is connected to the upper area R1 via the connecting part 34, while the main area R0 is connected to the lower area R2 via the connecting part 35. It is preferable that the maximum thickness of the connecting parts 34, 35 be thinner than, the minimum thickness of the auxiliary areas.

As shown in FIG. 5B, the plate 49 is a ring-shaped member with a circular external shape, wherein a horizontally-elongated plate hole 49*a* is formed in the plate 49. The plate 49 is fixed to the rear face of the head 30 by way of the adhesive. When the plate 49 is fixed to the head 30, the upper edge of the plate hole 49*a* matches with the upper edge of the groove 34*a* while the lower edge of the plate hole 49*a* matches with the lower edge of the groove 35*a*.

As shown in FIGS. 5C and 5D, the frame 40 is a ring-shaped member with a horizontally-elongated frame hole 41. The plate hole 49*a* of the plate 40 (see FIG. 5B) is bigger than the frame hole 41 of the frame 40 (see FIGS. 5C, 5D) in the vertical direction and in the horizontal direction. Alternatively; the plate hole 49*a* is the same size as the frame hole 41. The intermediate part of the frame 40 in the vertical direction is recessed in comparison with the upper and lower parts, and therefore a plurality of step differences 42 (i.e. 42-1, 42-2 serving as openings) is formed in the left and right sides of the frame 40. The lower area below the step differences 42 and the upper area above the step differences 42 are larger in thickness than the step differences 42, and therefore the surfaces of the upper and lower areas serve as receiving faces 43 which come in contact with the plate 49. The periphery of the frame 40 is divided into an upper periphery 44 and a lower periphery 45. When the plate 49 is assembled with the frame 40, the cutouts 33-1, 33-2 are positioned to face the step differences 42-1, 42-2 respectively.

The electronic percussion instrument is manufactured by assembling parts in the following manner. First, the stay 20 is fixed to the upper portion of the stand 10 via screws (see FIG. 1B). A plurality of cushion layers 18 which are laminated in the front-rear direction is attached to the cushion-holding member 19, wherein an impact sensor 17 made of a piezoelectric sensor is interposed between the cushion layers 18 which are laminated in the front-rear direction (see FIGS. 3, 4). Together with the stay 20, the flange of the cushion-holding member 19 is fixed to the rear face of the frame 40 of the pad member PD via screws (see FIG. 1B). In the process of fixing the stay 20 and the cushion-holding member 19 to the frame 40, it is possible to use the frame 40 independently of associated parts. Alternatively, it is possible to use the pad member PD which is furnished with the frame 40 in advance.

The pad member PD is produced by assembling parts in the following manner. First, it is necessary to prepare an intermediate product in which the plate 49 is adhered to the rear face of the head 30 (see FIG. 5B). The rear side of the intermediate product is positioned opposite to the surface of the frame 40 such that the plate hole 49*a* matches with the frame hole 41 (see FIG. 5C) in precise positioning. The folded parts 32 of the periphery 31 of the head 30 are engaged with the peripheries 44, 45 of the frame 40 such that the folded parts 32 are externally covered with the peripheries 44, 45 respectively. Due to the formation of the cutouts 33 and the notches 36 in the plate 49, it is easy for a worker to engage the folded parts 32 of the head 30 with the peripheries 44, 45 of the frame 40.

Thus, it is possible to completely produce the pad member PD when the head 30 is assembled with the frame 40, wherein the upper and lower parts of the plate 49 are brought in contact with the receiving faces 43 of the frame 40. Additionally, a protective material having flexibility such as a knitted material, is attached to and entirely covers the front face of the head 30. A space is formed between, the cutout 33-1 and the step difference 42-1 is the front-rear direction while another space is formed between the cutout 33-2 and the step difference 42-2. Those spaces are air vents which are formed in the left and right sides of the pad member PD so as to communicate with the external air (see FIG. 1B and FIG. 4).

As shown in FIGS. 3 and 4, apart of the cushion layers 18 is introduced info the frame hole 41 such that the front face of the cushion layers 18 comes in contact with the rear face of the head 30 (in particular, the rear face of the main strike area 38) when the stay 20 and the cushion-holding member 19 are fixed to the pad member PD.

Next, the rear cover 11 is fixed, to the upper rear part and the lower rear part of the stay 20 via screws. The periphery of the front cover 25 is engaged with the inside of the edge of the rear cover 11, and then the rear cover 11 and the front cover 25 are assembled together by use of the six hooks 12 in the front-rear direction. Then, a plurality of screws is applied to the rear parts of the hooks 12, which are thus attached to the rear side of the rear cover 11. Herein, the distal ends of screws press the rear cover 11 in the forward direction, while the front parts of the hooks 12 press the front cover 25 in the backward direction. Thus, it is possible to firmly attach the from cover 25 to the rear cover 11.

It is important in the present embodiment that the front cover 25 entirely covers the external periphery of the pad member PD but that the front cover 25 does not come in direct contact with the pad member PD. In other words, the pad member PD is supported by the stand 10 via the stay 20, but the front cover 25 does not at ail contribute to the support of the pad member PD. In this connection, the present embodiment is not necessarily limited to the foregoing method, of fixing the rear cover 11 and the front cover 25; hence, the hooks 12 are not essential to the present embodiment. It is possible to employ an integrally-unified cover which unifies the rear cover 11 and the front cover 25. A plurality of slits 26 is formed in the left and right sides of the front cover 25 at the predetermined positions which match the positions of the cutouts 33 and the positions of the step differences 42 (see FIG. 1A and FIG. 2). In this connection, it is possible to replace the slits 26 each having a thin shape with other types of openings demonstrating air ventilation such as circular holes and rectangular holes.

In the present embodiment adopting a twin-beater foot pedal device, the main strike area 38 is a horizontally-elongated elliptical shape as shown in FIGS. 1A and 2A. As described above, a knitted material is adhered to the surface of the head 30, whereas the following description does not necessarily discriminate the knitted material and the surface of the head 30.

Vibration occurs on the head 30 when, the main strike area 38 of the head 30 is struck with a beater. Vibration of the head 30 is transmitted to the impact sensor 17 via the foremost layer of the cushion layers 18. The impact sensor 17 converts vibration into an electric signal (e.g. an electric voltage), which is output as a detection signal. The electronic percussion instrument detects a striking operation applied to the head 30 with a beater when the detection signal exceeds the predetermined threshold. Based on the detection result, the electronic percussion instrument produces a musical sound with a volume corresponding to the detection signal at the timing of detecting a striking operation by way of a musical sound generating system (not shown).

The present embodiment is characterized by implementing a countermeasure to reduce an impulsive sound when a beater strikes the head 30. An impulsive sound is a mechanical sound which is generated, independently of an electronic musical, sound, which, is electronically generated based on a detection signal of the impulse sensor 17, when a beater strikes the head 30. In the conventional structure in which the periphery of the head 30 is entirely fixed to the periphery of the frame 40, the internal area of the head 30 in the radius direction is entirely vibrated, due to a striking operation on the head 30 with a beater; this may rapidly increase the back pressure of the head 30. Due to this phenomenon, the conventional structure suffers from a large impulsive sound which occurs mechanically due to a striking operation on the head 30 with a beater. The present embodiment aims to reduce or suppress an impulsive sound and to improve a tone color by introducing the grooves 34*a*, 35*a* and the cutouts 33 in the head 30 as well as the plate 49.

Figure 9:
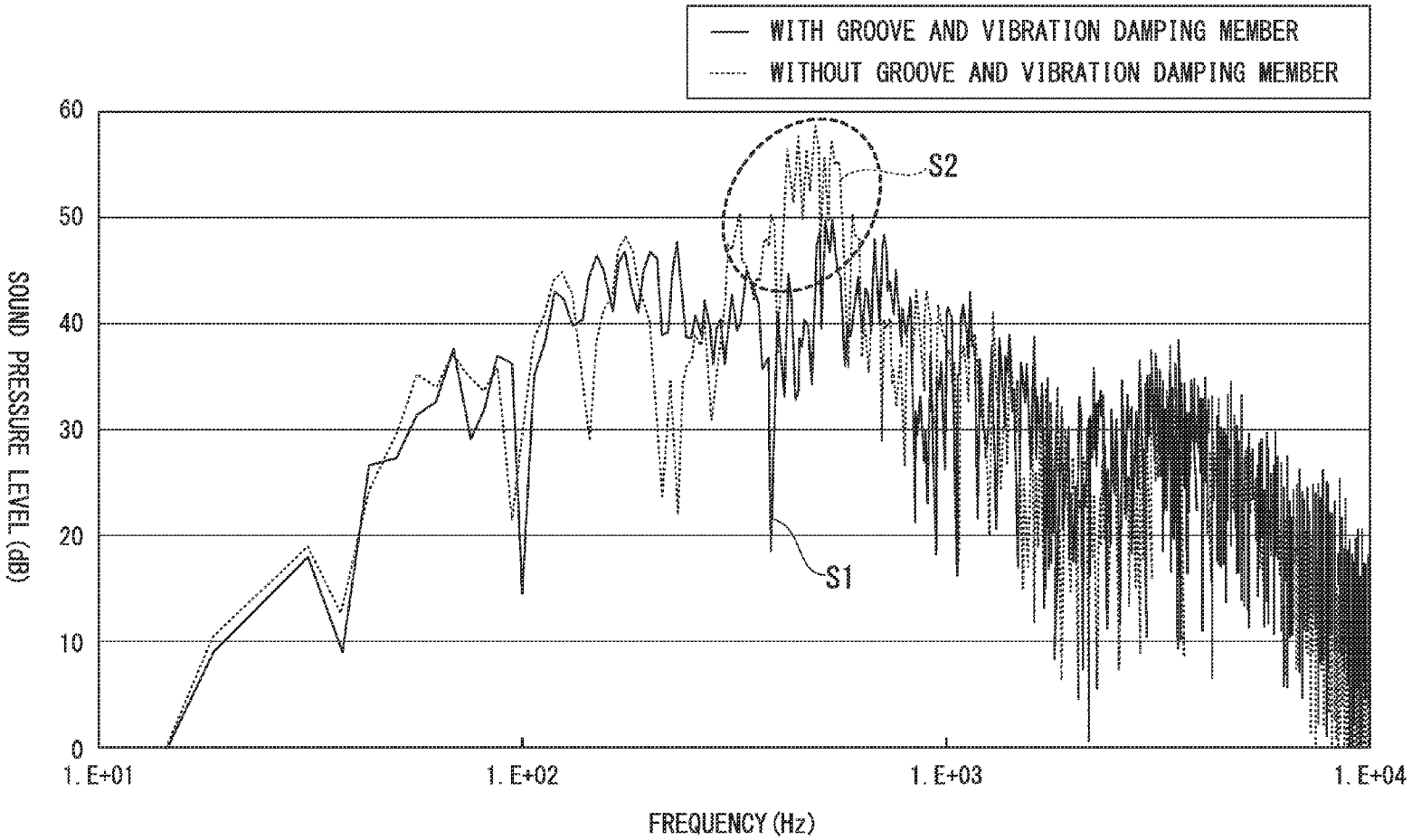
FIG. 9 is a graph showing frequency characteristics of impulsive sounds with or without a vibrating damping member and a groove in the back of the head of the electronic percussion instrument.

FIG. 9 shows frequency characteristics of impulsive sounds S1, S2, wherein the impulsive sound S1 is measured with the head structure including a groove and a vibration-damping member in the back of the head, while the impulsive sound S2 is measured with the head structure precluding a groove and a vibration-damping member. As shown by a dotted circle in FIG. 9, the peak portion of the impulsive sound S1 is significantly attenuated in sound, pressure in comparison of the peak portion of the impulsive sound S2. This demonstrates an advantageous effect of the present embodiment including a groove and a vibration-damping member in the back of the head in terms of frequency characteristics and noiselessness.

In the head 30 (see FIGS. 5A and 5B), the main area R0 is connected to the upper area R1 and the lower area R2 via the connecting parts 34 and 35 each having a thinner thickness. Due to the connecting parts 34 and 35 serving as hinges, the head 30 is not uniformly vibrated at a striking operation on the head 30 with a beater, but the main area R0 is relatively vibrated about the connecting parts 34 and 35 serving as the oscillating points for the upper area R1 and the lower area R2. This reduces the vibrating area in the head 30 so as to reduce an impulsive sound in volume. Additionally, the thickness of the main area R0 is not smaller than the thickness of the connecting parts 34 and 35; this may not increase the pitch of an impulsive sound, thus improving sound quality while reducing mechanical noise.

Due to the formation of the cutouts 33 in the left and right sides in the periphery 31 of the head 30, even when the back pressure of the head 30 is varied due to vibration of the head 30 at a striking operation, air may pass through the cutouts 33 so as to alleviate variations of the back pressure of the head 30. Additionally, the step differences 42 of the frame 40 cooperate with, the cutouts 33 to form air ventilation, thus smoothing the inlet and outlet of air in the head 30. That is, it is possible to secure adequate air ventilation in the back of the head 30 being struck with a beater, thus reliably securing noiselessness while reducing noise.

It is necessary to arrange at least one cutout 33 serving as an air vent in the periphery 31 of the head 30, and it is preferable to arrange a plurality of cutouts 33 in order to achieve efficient air ventilation. In particular, it is preferable to arrange a pair of cutouts 33 which are disposed opposite to each other with the maximum distance therebetween in the circumferential direction in terms of effective air ventilation. In the present embodiment, the left-side cutout 33-1 is positioned opposite to the right-side cutout 33-2 by way of the main area R0; but this is not a restriction. It is possible to divide the circular-shaped head 30 into a pair of semicircular sections, each of which may arrange at least one air vent. In this connection, it is possible to secure a high air-ventilation effect on the condition that distance between the opposite position of the cutout 33-1 and the cutout 33-2 is shorter than the distance between the cutouts 33-1 and 33-2.

The front cover 25 includes a plurality of slits 26 which are positioned at the same positions as the cutouts 33 and the step differences 42 in the circumferential direction of the head 30. Thus, it is possible to cover the head 30 with the front cover 25 without limiting air ventilation via the cutouts 33 and the step differences 42.

The electronic percussion instrument may be degraded in terms of the precision of detecting a striking operation on the head 30 with a beater due to vibration which is continued for a relatively long time due to a large vibration applied to the entirety of the head 30. To overcome this event, the present embodiment introduces the hard plate 49 which encompasses the main strike area 38 in the head 30. Thus, it is possible to suppress a large vibration which occurs on the head 30 being struck with a beater, and therefore it is possible to attenuate vibration and to improve the precision of detecting a striking operation. Additionally, it is possible to reliably reduce an impulsive sound, which is mechanically generated when the head 30 is struck with a beater, due to vibration suppression. In particular, the present embodiment demonstrates a high vibration-damping effect due to close adherence of the plate 49 to the frame 40. Additionally, the present embodiment demonstrates a high vibration-damping effect in all the radius directions about the main strike area 38 due to the seamless ring-shape of the plate 49. On the other hand, the present embodiment does not degrade a player's sensation to strike the head 30 with a beater since the plate 49 does not interfere with the main strike area 38.

Due to the formation of the "thinned" connecting parts 34 and 35 in the head 30, it is possible to suppress an impulsive sound (i.e. a mechanical sound which occurs when the head 30 is struck with a beater) and to improve sound quality while reducing mechanical noise. Due to the formation of the cutouts 33 and the step differences 42 at the predetermined positions which do not interfere with the main area R0 including the main strike area 38, it is possible to easily vent air in the back of the head 30 being struck with a beater, thus improving sound quality while reducing mechanical noise. Due to the arrangement of the plate 49, it is possible to suppress vibration which occurs on the head 30 being struck with a beater, thus reducing an impulsive sound and improving the precision of detecting a striking operation on the head 30.

The present embodiment is characterized in that the connecting parts 34 and 35 are horizontally and linearly elongated while the main area R0 is laterally elongated. Additionally, the main strike area 38 of the head 30 is encompassed by the plate 49 in conformity with the plate hole 49*a*, and therefore the main strike area 38 is laterally elongated. Thus, the electronic percussion instrument of the present embodiment demonstrating a vibration-damping effect is applicable to a twin-beater bass drum set.

When the frame 40 is fixed in position by way of the periphery 31 of the head 30, the peripheries 44 and 45 of the frame 40 are externally covered with the folded parts 32 of the periphery 31, and therefore the frame 40 is firmly attached to the head 30. Due to the formation of the cutouts 33 in the periphery 31 of the head 30, it is easy for a worker to fix the position of the frame 40 such that folded parts 32 are wound about the peripheries 44 and 45. In particular, the cutouts 33 are formed in proximity to the left and right ends of the connecting parts 34 and 35 in connection with the periphery 31 of the head 30 close to the main area R0. This makes it easy for a worker to process the cutouts 33 and the connecting parts 34, 35. In other words, the present embodiment is advantageous in terms of the manufacturing of the head 30 applicable to a twin-beater bass drum set.

It is possible to create various types of the head 30, each of which is able to suppress an impulsive sound when the head 30 is struck with a beater. Variations of the head 30 will be described with reference to FIGS. 6A to 6E.

Figure 6A:
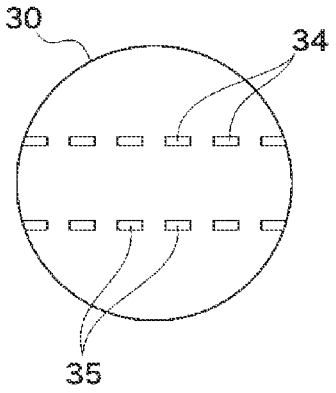
FIG. 6A is a front view showing a first variation of the head of the electronic percussion instrument.
Figure 6B:
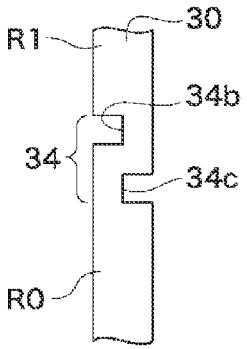
FIG. 6B is a side view showing a second variation of the head of the electronic percussion instrument.

It is not essential to continuously form the connecting parts 34, 34 and the grooves 34*a*, 35*a*, which can be intermittently disconnected. FIG. 6A shows a first variation of the head 30 in which the connecting parts 34 and 35 are each intermittently disconnected at various points, which can demonstrate a mechanical noise suppression effect as well. Additionally, it is not essential to form one connecting part (e.g. the connecting part 34) as a single groove, and therefore the connecting part can be redesigned such that the front and rear sides thereof are alternatively recessed in the head 30. FIG. 6B shows a second variation of the head 30 in which the connecting part 34 is configured of a pair of grooves 34*b* and 34*c* which are positioned adjacent to each other and which are alternatively recessed on the front and rear sides. The other connecting part 35 can be redesigned in a similar manner to the connecting part 34. It is necessary for the connecting parts 34 and 35 to be reduced in thickness in comparison with the upper area R1 and the lower area R2. In this connection, the connecting parts 34 and 35 are not necessarily shaped like grooves, and therefore they can be formed in other shapes. Additionally, the connecting parts 34 and 35 are not necessarily formed in linear shapes; hence, they can be formed in S-shapes or carved shapes.

Figure 6C:
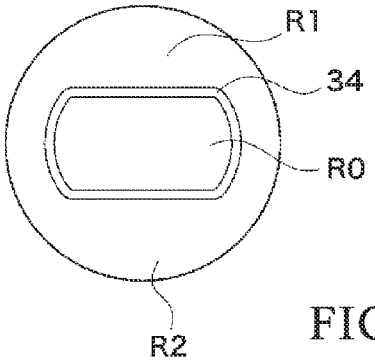
FIG. 6C is a front view showing a third variation of the head of the electronic percussion instrument.

It is not necessary to form two connecting parts 34 and 35; hence, a single connecting part may sufficiently demonstrate a mechanical noise suppression effect. FIG. 6C shows a third variation of the head 30 with a single ring-shaped connecting part 34. The main area R0 is encompassed inside the ring-shaped connecting part 34, while the auxiliary areas (i.e. the upper area R1 and the lower area R2) are positioned outside the ring-shaped connecting part 34. The main area R0 and the auxiliary areas are connected together via the "thinned" ring-shaped connecting part 34.

Figure 6D:
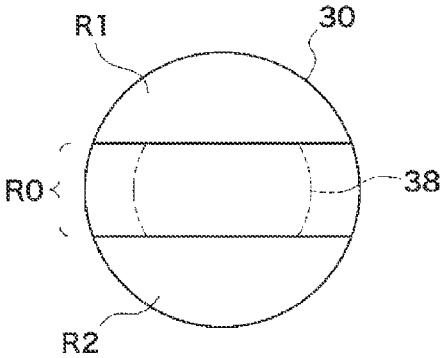
FIG. 6D is a front view showing a fourth variation of the head of the electronic percussion instrument.

In the present embodiment, the head 30 is designed such that the main area R0 and the auxiliary areas (i.e. the upper area R1 and the lower area R2) are connected together via the connecting parts 34 and 35; but this is not a restriction. The connecting parts 34 and 35 need to be reduced in thickness in comparison with the auxiliary areas; hence, it is possible to redesign the head 30 such that all the main, area R0 and the connecting parts 34, 35 have the same thickness. FIG. 6D shows a fourth variation of the head 30 in which the main area R0 is reduced in thickness in comparison with the auxiliary areas such that the connecting parts 34 and 35 cannot be visibly recognized as constituent elements in the main area R0. This structure can be regarded such that the main area R0 is directly connected to the auxiliary areas. Strictly speaking in terms of the thickness, the maximum thickness of the main area R0 is smaller than the minimum thickness of the auxiliary areas.

Figure 6E:
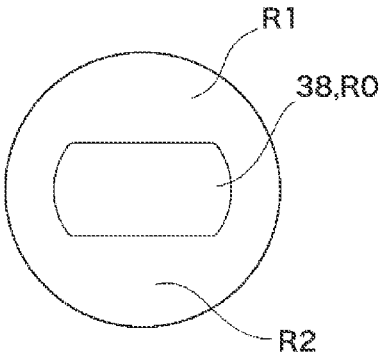
FIG. 6E is a front view showing a fifth variation, of the head, of the electronic percussion instrument.

FIG. 6E shows a fifth variation of the head 30 in which the main strike area 30 is solely reduced in thickness rather than the other areas such that the main strike area 30 will match with the main area R0. In this structure, the main area R0 is encompassed by the ring-shaped auxiliary area (serving as the upper area R1 and the lower area R2).

As described above, the above variations of the head 30 shown in FIGS. 6A to 6E are able to suppress an impulsive sound which occurs when the head 30 is being struck with a beater, thus improving sound quality while reducing mechanical noise.

In terms of suppression of vibration at a striking operation, it is necessary for the plate 49 (serving as a vibration-damping member) to encompass the main strike area 38 (or to sandwich the main strike area 38) in the plane parallel to the striking surface of the head 30. For this reason, it is not necessary to form the plate 49 in a complete ring-shape. Variations of the plate 49 will be described with reference to FIGS. 7A to 7C.

Figure 7A:
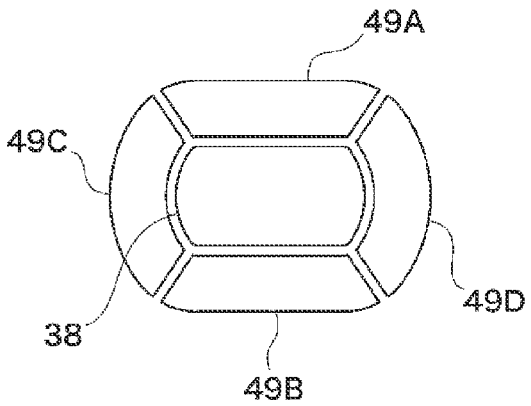
FIG. 7A is a front view showing a first variation of the plate in connection with the head of the electronic percussion instrument.
Figure 7B:
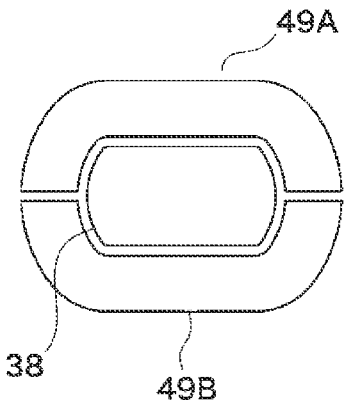
FIG. 7B is a front view showing a second variation, of the plate in connection with the head of the electronic percussion instrument.
Figure 7C:
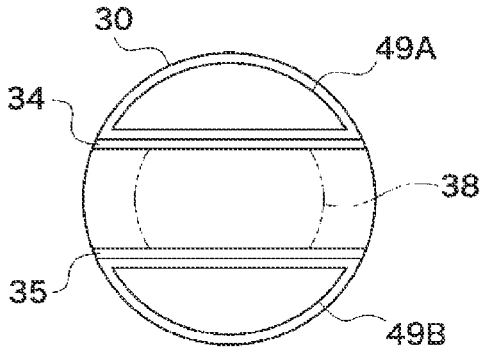
FIG. 7C is a front view showing a third variation of the plate in connection with the head of the electronic percussion instrument.

FIG. 7A shows a first variation of the plate 49 which is divided into a plurality of plates 49A to 49D which are arranged adjacent to each other around the main strike area 38 in the circumferential direction with gaps therebetween. FIG. 7B shows a second variation of the plate 49 which is vertically divided into a pair of plates 49A and 49B which are arranged to encompass the main strike area 38. FIG. 7C shows a third variation of the plate 49 which is separately divided into an upper plat 49A above the connecting part 34 and a lower plate 49B below the connecting part 35.

In either case, the plate 49 is arranged in the area precluding the main strike area 38, whereas the plate 49 is not necessarily arranged in the rear side of the head 30 but can be arranged in the front side of the head 30 or in the inside area of the head 30. Alternatively, the plate 49 can be arranged in at least one of the rear side, the front side, and the inside area of the head 30. Additionally, it is possible to arrange the plate 49 in both the front side and the rear side of the head 30. In this connection, the plate 49 is not necessarily adhered to the head 30 but can be inserted into the head 30 by way of the insert molding. To increase a vibration-damping effect, it is necessary to closely adhere the plate 49 to the frame 40, whereas it is not necessary to directly attach the plate to the frame 40. Similar to the insert molding in which the plate 49 is inserted in the head 30, it is possible to indirectly attach the plate 49 to the frame 40.

Figure 8A:
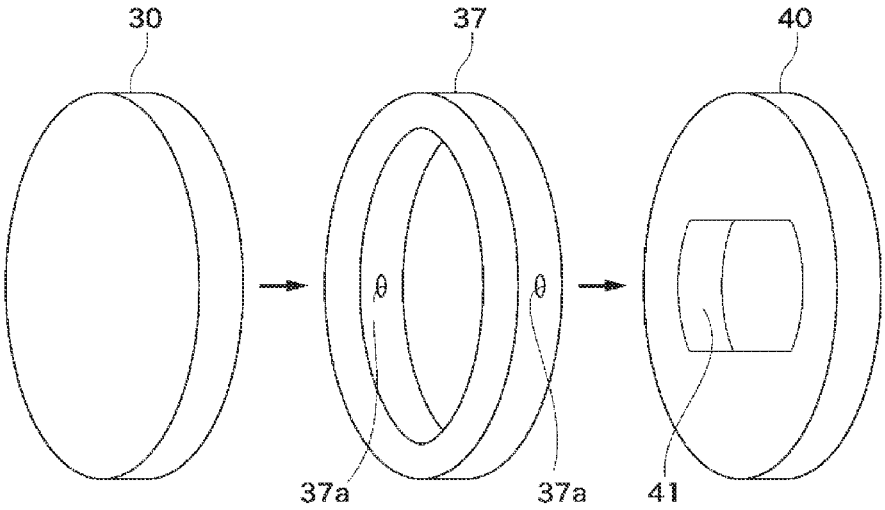
FIG. 8A is an exploded perspective view showing a modified example of a pad member in which the head is connected to the frame via a joint member.
Figure 8B:
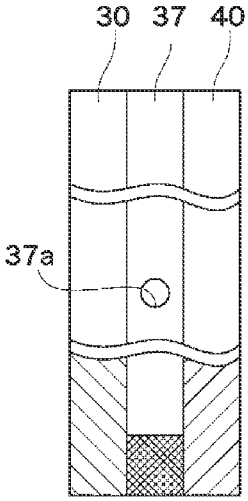
FIG. 8B is a cross-sectional view showing the modified example of the pad member including the head, the joint member with a through-hole, and the frame.

In this connection, apart of the frame 40 which is attached to the periphery 31 of the head 30 will be referred to as a head mount portion, which corresponds to the peripheries 44 and 45 of the frame 40. It is not essential that the periphery 31 of the head 30 be directly attached to the frame 40. FIGS. 8A and 8B show a modified example of the pad member PD in which the periphery 31 of the head 30 is connected to the head mount portion of the frame 40 via a ring-shaped joint member 37 which is arranged independently of the head 30 and the frame 40. In this structure, the frame 40 is not necessarily formed in a circular shape, and therefore the frame 40 can be increased in size to be larger than the head 30. For convenience sake. FIGS. 8A and 8B preclude the illustration of the plate 49.

For the purpose of air ventilation in the back of the head 30 at a striking operation, it is necessary for the present embodiment to form the cutouts 33 of the head 30 and the step differences 42 of the frame 40 as air vents which allow air to pass therethrough at a striking operation of the head 30; but this is not a restriction. To provide a sufficient air ventilation effect, it is necessary to arrange an air vent in at least one of the periphery 31 of the head 30, the joint member 37, and the head mount portion of the frame 40.

Figure 8C:
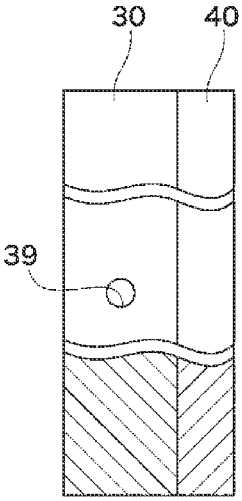
FIG. 8C is a cross-sectional view showing a further modified, example of the pad member including the head with a through-hole, and the frame.
Figure 8D:
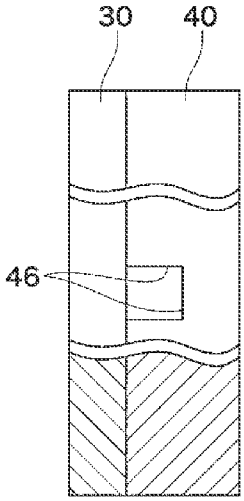
FIG. 8D is a cross-sectional view showing a further modified example of the pad member including the head and the frame with a cutout.

In the structure shown in FIGS. 8A and 8B, for example, it is necessary to form a through-hole 37*a* serving as an air vent at one position in the external periphery of the ring-shaped joint member 37. It is possible to preclude the joint member 37 as shown in FIG. 8C, in which a through-hole 39 serving as an air vent is formed instead of the cutout 33 in the head 30. Alternatively, as shown in FIG. 8D, it is possible to form a cutout 46 serving as an air vent in the frame 40. In this connection, it is possible to arbitrarily combine the through-holes 37*a*, 39 and the cutout 46, which can be formed by way of the mechanical molding or the metal molding.

Figure 10C:
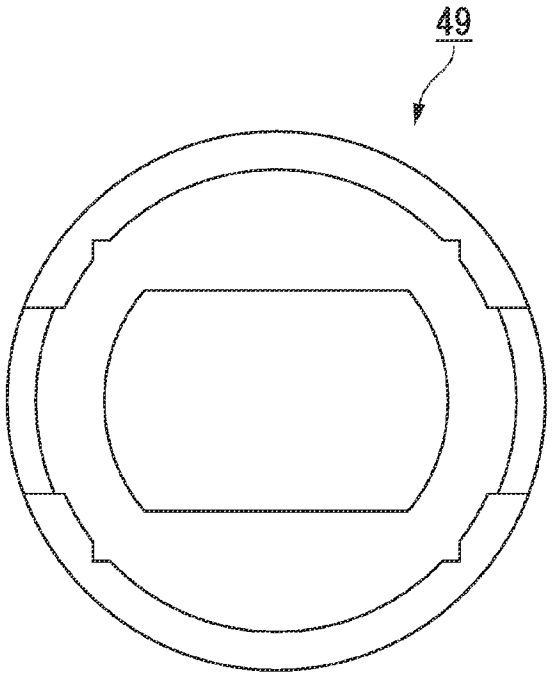
FIG. 10C is a rear view of a further variation of a plate made of an iron serving as a vibration-damping member, the front side of which is covered with the head of FIG. 10A in an electronic percussion instrument.
Figure 10B:
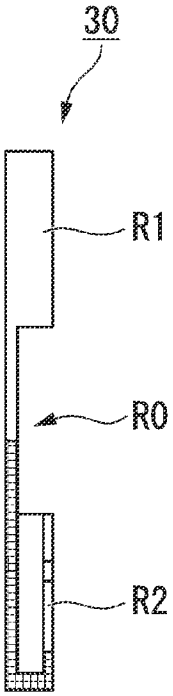
FIG. 10B is a cross-sectional view partly in side section of the further variation of the head shown in FIG. 10A.
Figure 10A:
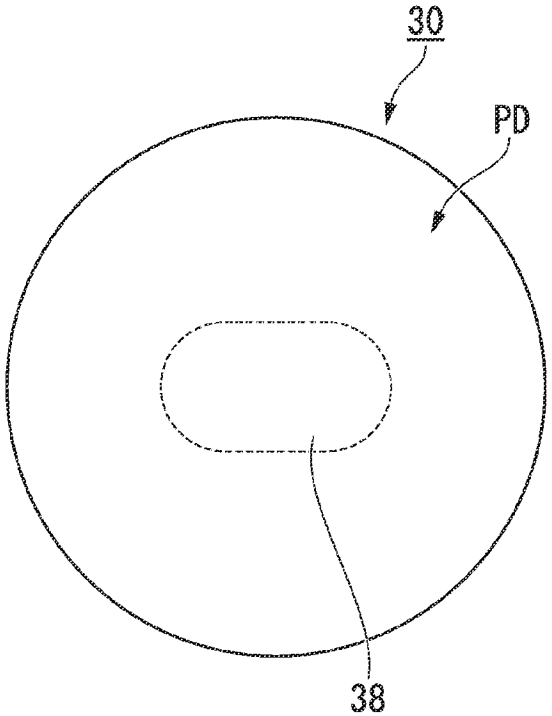
FIG. 10A is a front view showing a further variation of a head made of rubber in an electronic percussion instrument.

The present embodiment employs the plate 49 having the connecting parts 34, 35 and the grooves 34*a*, 35*a*; but this is not a restriction. It is possible to redesign the plate 49 without forming the grooves 34*a*, 35*a*. FIGS. 10A to 10C show a further variation of the plate 49, precluding the grooves 34*a*, 35*a*, which is covered with the head 30 in an electronic percussion instrument. FIG. 10A is a front view of the head 30 in which the main strike area 38 is simply arranged in the center area of the pad member PD made of rubber, and FIG. 10B is a side view of the head 30 which is divided, into the main area R0 and the auxiliary areas R1, R2. FIG. 10C is a rear view of the plate 49 made of an iron, in which no grooves are formed between the main area R0 and the auxiliary areas R1, R2. The center area of the plate 49 corresponding to the main area R0 of the head 30 is reduced in thickness in comparison with the peripheral area of the plate 49 corresponding to the auxiliary areas R1, R2 of the head 30, thus reducing a vibration from being transmitted on the entire surface of the head 30.

Noticeably, no conventional arts are designed to provide air ventilation in the back of a head of an electronic percussion instrument. The present embodiment is characterized by employing a unique structure in which the cutouts 33 and the grooves 34 formed in the back of the head 30 cooperate with the step differences 42 formed in the frame 40 so as to secure adequate air ventilation in the back of the head 30, thus reliably securing noiselessness while reducing noise due to an impact on the head 30 in playing the electronic percussion instrument. As shown in FIGS. 10A-10C, it is not necessary to form the grooves 34 in the back of the head 30, but the grooves 34 may create a synergy effect of damping vibration which may be transmitted to the peripheral area about the strike area of the head 30.

Figure 11A:
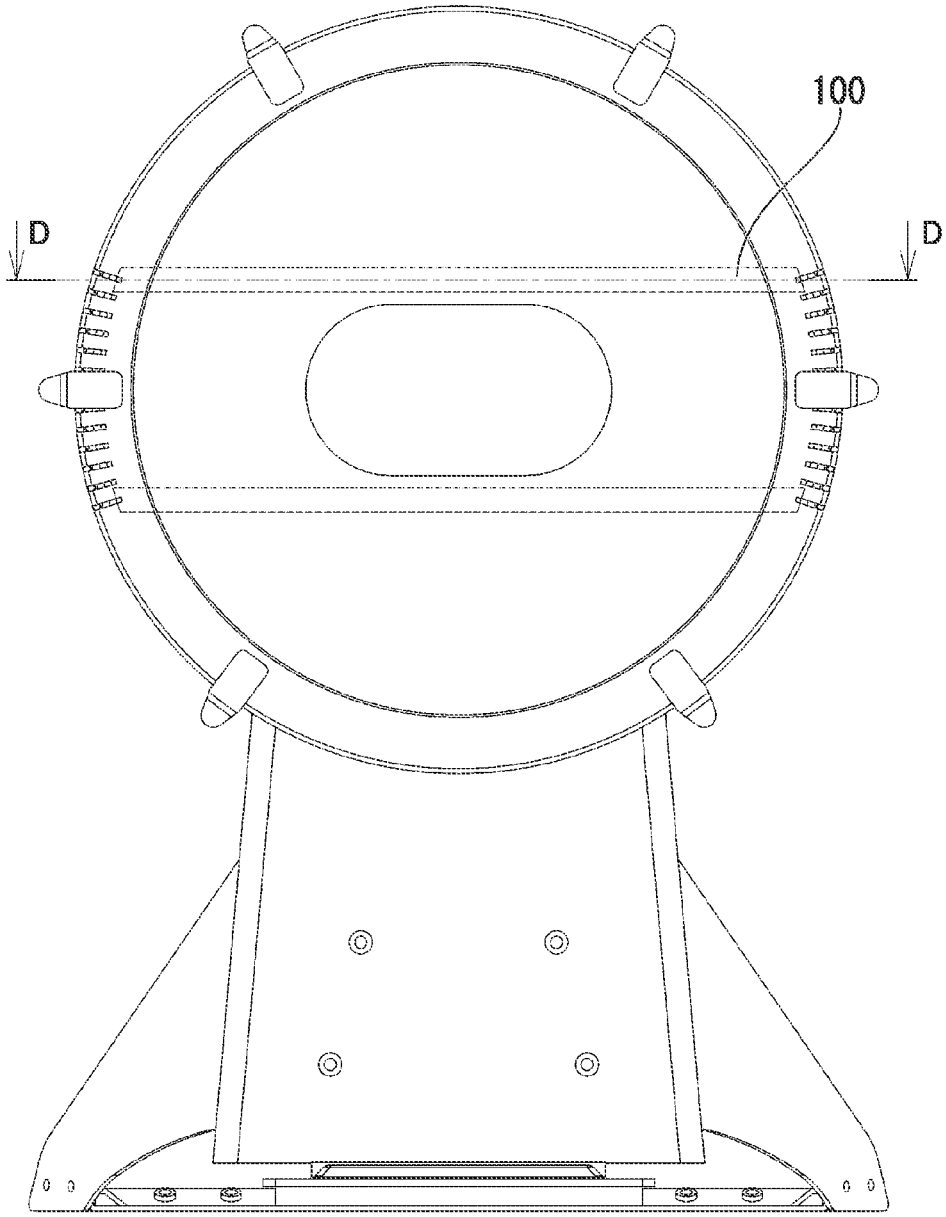
FIG. 11A is a front view of an electronic percussion instrument which is used to illustrate the technical feature of the present invention.
Figure 11B:
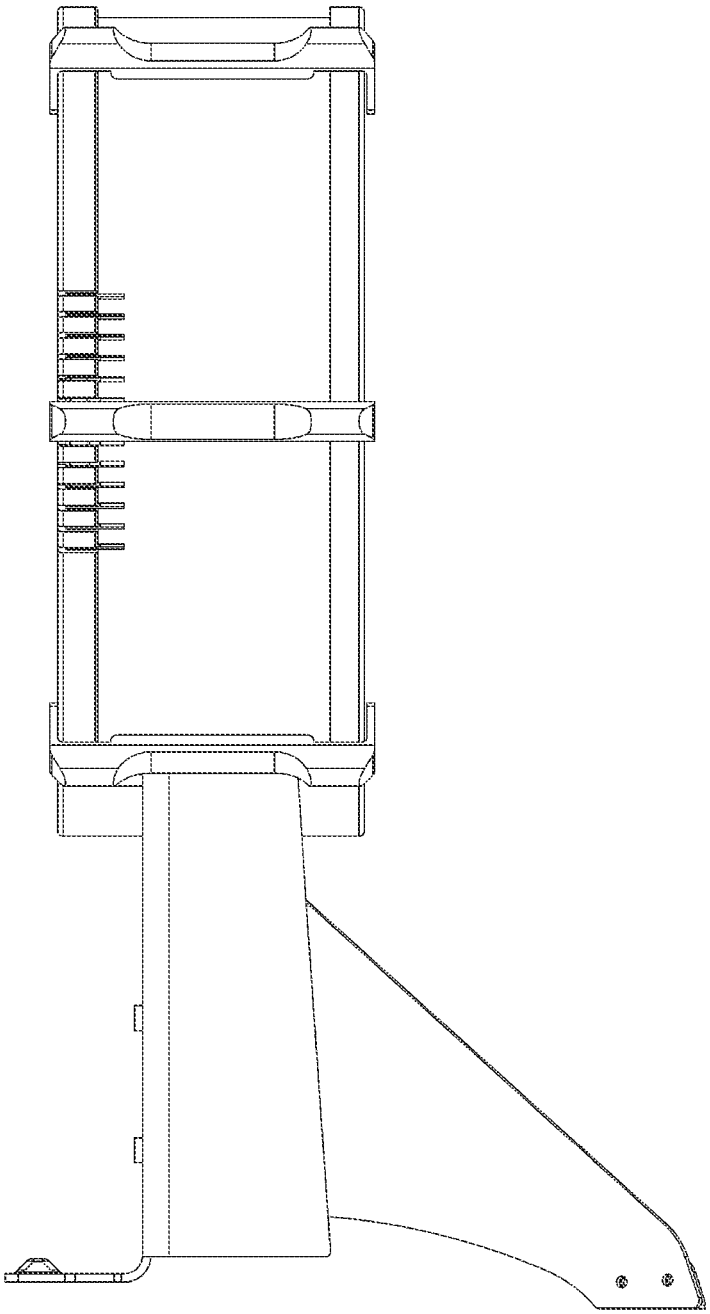
FIG. 11B is a side view of the electronic percussion instrument of FIG. 11A.
Figure 11C:
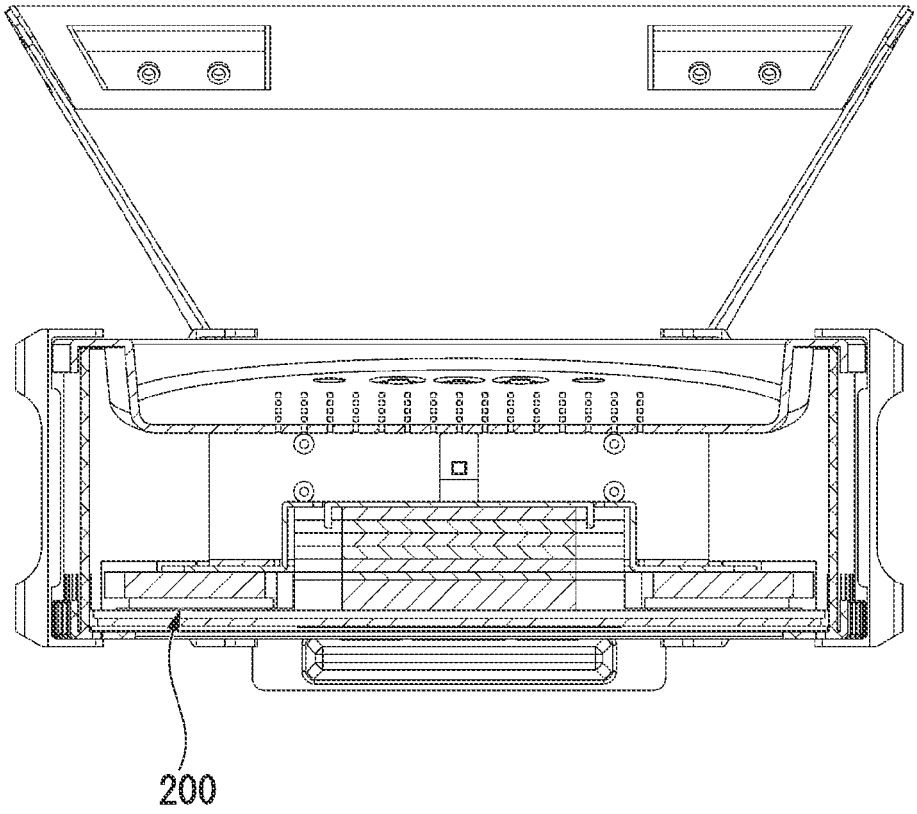
FIG. 11C is a cross-sectional view taken along line D-D in FIG. 11A in view of the upper side of the electronic percussion instrument of FIG. 11A.

FIGS. 11A to 11C show an electronic percussion instrument equipped with the technical feature of the present invention. As shown in FIG. 11A, the head is furnished with a rubber pad having a strike area while a groove 100 is formed in the back of the head. As shown in FIG. 11C which is a cross-sectional view taken along line D-D in FIG. 11A in view of the upper side of an electronic percussion instrument, an air ventilation mechanism 200 is formed via a clearance gauge between the groove 100 of the rubber pad and a hard material which supports the back of the head. The present invention is characterized by the air ventilation mechanism 200 which aims to release air from the back of the head being struck with a beater, thus reliably securing noiselessness while reducing noise due to an impact on the head.

Lastly, the present, invention is not necessarily limited to the foregoing embodiment and variations, which can be further modified in various ways within the scope of the invention as defined by the appended, claims. The technical features of the present invention can be summarized as follows.

(1) At least two spaces (serving as air vents) are formed at the opposite ends of the periphery of the head serving as a fixing member, which is folded to enclose the periphery of the frame, wherein the opposite ends may communication with each other via an air duct. Two or more spaces may accommodate a plurality of elastic fixing members (which, can be arranged independently of each other), which makes it easy for a worker to attach the head to the frame. After fixture of the head with the frame, it is possible to form a plurality of air vents which may vent air in different directions, thus securing noiselessness against an impact on the head being struck with a beater. In this connection, it is possible to arrange one space at one end of the periphery of the head like a Landolt ring having a single opening. In this case, the fixing member may be initially engaged with the opening and then fixed to the opposite end of the periphery of the head.

(2) At least two spaces may be positioned at the right and left positions in the periphery of the head, thus dividing an elastic fixing member into upper and lower sections. In an assembling operation in which the frame is engaged with the periphery of the head, it necessary for a worker to simply push the fixing member upwardly and downwardly; this simplifies an assembling operation. Additionally; it is possible to vent air in a lateral direction (or a vertical direction) via two spaces in the periphery of the head; this may limit an air flow, which occurs due to temporarily recessing of the head being struck with a beater, from propagating towards a player who plays an electronic percussion instrument.

(3) The folded portion of the periphery of the head may be partially protruded in a direction from, the inside of the head to the back of the head, while the space may be formed with smaller protrusion than the folded portion of the periphery of the head. When the folded portion of the periphery of the head is the same height as the back of the head which is thus approximately formed in the flat shape, it is possible to easily deform or bend the strike area of the head.

(4) It is possible to form a plurality of folded portions, which are distanced from each other, along the periphery of the head having a circular shape, wherein each folded portion is formed by partially protruding and then, inwardly folding the periphery of the head. In this connection, both the head and the frame are formed in a disk-like shape or a ring shape. Alternatively, it is possible to use a frame having a rectangular shape which may entirely encompass a head having a circular shape.

(5) At least one recess (or at least one thinned groove) is formed in the back of the head and interposed between two elastic fixing members positioned at the opposite ends of the head. The groove of the head may be expanded due to a strike operation applied to the head with a beater, while the groove of the head can be expanded when the frame is attached to the head; this makes it easy for a worker to assemble the head and the frame together. Additionally, the direction of the space(s) match the direction of the groove (or the thinned recess), thus facilitating air ventilation.

(6) A cover having a plurality of slits may be attached to the periphery of the head, wherein slits are positioned in correspondence with spaces formed in the periphery of the head. This improves an air ventilation effect so as to improve a noise reducing effect. In this connection, the present invention does not necessarily need a cover, which is not an essential part in an electronic percussion instrument.

(7) To improve a player's sensation to strike a head with a beater, it may be necessary to smoothly process the surface of the head of an electronic percussion instrument. To prevent, the surface of the head from being scraped with a beater, it may be necessary to use a flexible material for the head of an electronic percussion instrument.

(8) It is possible to attach a vibration-damping material, which may suppress vibration occurring on the head being struck with a beater, in the back of the head by use of the adhesive or by way of insert molding.

What is claimed is:

1. An electronic percussion instrument comprising:

a frame having a head-attaching portion;

a head, which is made of an elastic material with a higher flexibility than the frame, which includes a main strike area which is disposed on a surface and mainly subjected to a striking operation, and whose periphery is directly fixed to the head-attaching portion of the frame or whose periphery is fixed to the head-attaching portion of the frame via a joint member; and an impact sensor which converts a vibration occurring on the main strike area subjected to a striking operation into an electric signal, wherein an opening which allows air to transmit there through at the striking operation is formed in a portion of the head circumventing the main strike area such that the main strike area is opening-free.

2. The electronic percussion instrument according to claim 1, wherein the opening includes at least a pair of a first opening and a second opening, the first opening and the second opening being spaced apart from each other by a portion of the head circumventing the main strike area that does not include an opening.

3. The electronic percussion instrument according claim 2, further comprising a cover which is used to cover the periphery of the head, wherein a through-hole is formed at a position of the cover corresponding to the opening.

4. The electronic percussion instrument according to claim 2, wherein the impact sensor is disposed close to the main strike area of the head via a cushion material.

5. The electronic percussion instrument according to claim 1, wherein the opening is a cutout, and wherein the head is attached to the frame such that the periphery of the frame is externally enclosed with the periphery of the head except at the cutout.

6. The electronic percussion instrument according to claim 5, wherein a thinned portion which is elongated in a horizontal direction is formed in the head, and wherein the cutout is formed at each of opposite ends of the thinned portion in the periphery of the head.

7. The electronic percussion instrument according claim 6, further comprising a cover which is used to cover the periphery of the head, wherein a through-hole is formed at a position of the cover corresponding to the opening.

8. The electronic percussion instrument according to claim 6, wherein the impact sensor is disposed close to the main strike area of the head via a cushion material.

9. The electronic percussion instrument according to claim 5, wherein an upper connecting part and a lower connecting part which are linearly elongated in a horizontal direction is formed in the head, wherein an upper area above a main area including the main strike area of the head is connected to the main area via the upper connecting part while a lower area below the main area is connected to the main area via the lower connecting part, wherein the upper connecting part and the lower connecting part are reduced to be thinner in thickness than the upper area and the lower area, and wherein the cutout is formed in the main area within the periphery of the head.

10. The electronic percussion instrument according claim 9, further comprising a cover which is used to cover the periphery of the head, wherein a through-hole is formed at a position of the cover corresponding to the opening.

11. The electronic percussion instrument according to claim 7, wherein the impact sensor is disposed close to the main strike area of the head via a cushion material.

12. The electronic percussion instrument according claim 5, further comprising a cover which is used to cover the periphery of the head, wherein a through-hole is formed at a position of the cover corresponding to the opening.

13. The electronic percussion instrument according to claim 5, wherein the impact sensor is disposed close to the main strike area of the head via a cushion material.

14. The electronic percussion instrument according to claim 1, further comprising a cover which is used to cover the periphery of the head, wherein a through-hole is formed at a position of the cover corresponding to the opening.

15. The electronic percussion instrument according to claim 14, wherein the impact sensor is disposed close to the main strike area of the head via a cushion material.

16. The electronic percussion instrument according to claim 1, wherein the impact sensor is disposed close to the main strike area of the head via a cushion material.

17. An electronic percussion instrument comprising:

a frame having a head-attaching portion;

a head, which is made of an elastic material with a higher flexibility than the frame, which includes a main strike area which is disposed on a surface and mainly subjected to a striking operation, and whose periphery is directly fixed to the head-attaching portion of the frame or whose periphery is fixed to the head-attaching portion of the frame via a joint member; and an impact sensor which converts a vibration occurring on the main strike area subjected to a striking operation into an electric signal, wherein an opening which allows air to transmit there through at the striking operation is formed in at least one of the periphery of the head, the joint member, and the head-attaching portion, the opening circumventing the main strike area such that the main strike area is opening-free.

18. The electronic percussion instrument according to claim 17, wherein the opening includes at least a pair of a first opening and a second opening spaced apart from the first opening.

19. The electronic percussion instrument according claim 17, further comprising a cover which is used to cover the periphery of the head, wherein a through-hole is formed at a position of the cover corresponding to the opening.

20. The electronic percussion instrument according to claim 17, wherein the impact sensor is disposed close to the main strike area of the head via a cushion material.

* * * * *